US008734260B2

(12) United States Patent
Pececnik

(10) Patent No.: US 8,734,260 B2
(45) Date of Patent: May 27, 2014

(54) THREE-DIMENSIONAL AUDITORIUM WAGERING SYSTEM

(71) Applicant: Joze Pececnik, Smarca (SI)

(72) Inventor: Joze Pececnik, Smarca (SI)

(73) Assignee: Elektroncek D.D., Menges (SI)

( * ) Notice: Subject to any disclaimer, the term of this patent is extended or adjusted under 35 U.S.C. 154(b) by 0 days.

(21) Appl. No.: 13/631,195

(22) Filed: Sep. 28, 2012

(65) Prior Publication Data

US 2014/0094246 A1 Apr. 3, 2014

(51) Int. Cl.
*A63F 9/24* (2006.01)

(52) U.S. Cl.
USPC ..... 463/42; 463/25

(58) Field of Classification Search
USPC ..... 463/20, 25, 31–42
See application file for complete search history.

(56) References Cited

U.S. PATENT DOCUMENTS

| | | | | |
|---|---|---|---|---|
| 7,922,589 | B2 | 4/2011 | Kuhn et al. | |
| 8,034,263 | B2 | 10/2011 | Maass | |
| 8,172,400 | B2 | 5/2012 | OConnell et al. | |
| 8,177,368 | B2 | 5/2012 | OConnell et al. | |
| 2009/0109175 | A1 | 4/2009 | Fein et al. | |
| 2011/0149249 | A1 * | 6/2011 | O'Connell et al. | 353/10 |
| 2011/0281628 | A1 | 11/2011 | Sieka | |
| 2011/0319152 | A1 | 12/2011 | Ross et al. | |
| 2012/0122571 | A1 * | 5/2012 | DeSimone et al. | 463/31 |
| 2012/0270648 | A1 * | 10/2012 | Rasmussen et al. | 463/30 |
| 2012/0276967 | A1 * | 11/2012 | Watanabe | 463/11 |
| 2012/0282991 | A1 * | 11/2012 | Bontempo et al. | 463/17 |

OTHER PUBLICATIONS

Schaufler et al., A Three Dimensional Image Cache for Virtual Reality, http://www.cs.princeton.edu/courses/archive/spr01/cs598b/papers/schaufler96.pdf), Gernot Schaufler and Wolfgang Stürzlinger, GUP, Johannes Kepler Universität Linz, Altenbergerstr.69, A-4040 Linz, Austria/Europe. Printed from internet Sep. 28, 2012.

* cited by examiner

*Primary Examiner* — Masud Ahmed
(74) *Attorney, Agent, or Firm* — Mark A. Litman & Associates, P.A.

(57) ABSTRACT

A gaming system provides a wagering venue for multiple wagering positions. A processor executes code to simulate a physical random gaming event outcome using a random number generator. Memory stores three-dimensional video displayable image data of a device for the physical random gaming event outcome. A three-dimensional video display system has a three-dimensional image display field. At least two player input terminals and seating for the player input terminals within the at least 30 degree field of view. The processor i) identifies a wager from a specific player input terminal, ii) initiates generation of an event outcome in a random event outcome game, iii) generates an event outcome simulating a physical random event generating outcome; iv) selects image data from the memory of a three-dimensional event outcome in which the generated simulated physical random event outcome is shown; v) displays the selected image data; and resolves the wager based upon the generated event outcome.

20 Claims, 3 Drawing Sheets

THREE-DIMENSIONAL AUDITORIUM WAGERING SYSTEM

BACKGROUND OF THE INVENTION

1. Field of the Invention

The present invention relates to the field of wagering games, wagering games with display of random outcome event generators and wagering games with three-dimensional displays of random event outcome generators in an auditorium or stage setting.

2. Background of the Art

Casinos provide many different gaming formats and many different game events. The various gaming events can be provided in various physical gaming table formats (e.g., roulette, blackjack, poker variants, craps, candy wheels and the like), electronic gaming table formats, electronic video gaming systems, and mixed electronic and physical gaming element formats (e.g., playing cards and electronic wagering, physical roulette wheels and player wagering terminals, player cast dice and electronic wagering terminals, mechanically cast dice and electronic wagering terminals). Except for the ability in video wagering systems to swap active gaming engines on a processor, each of these games require dedicated gaming tables and associated apparatus. This need for dedicated physical apparatus is expensive and requires large areas for placement of apparatus for a single game. The physical gaming systems are also quite limited in their appearance and have maintained a traditional look in spite of the availability of more modern technologies.

U.S. Pat. Nos. 8,172,400; and 8,177,368 (O'Connell) and U.S. Pat. No. 8,034,263 (Maass) describe systems and apparatus useful in three-dimensional staged productions. Included may be any of an image projection apparatus comprising: a first projection device arranged to generate a virtual three-dimensional image; a second projection device arranged to project a background image; and means to minimize transparency of the virtual image relative to the background image; wherein the first projection device comprises a projector, a frame, and an at least partially transparent screen: the frame being arranged to retain the screen under tension, such that the screen is inclined at an angle with respect to a plane of emission of light from the projector; the screen having a front surface arranged such that light emitted from the projector is reflected therefrom; and the projector being arranged to project an image such that light forming the image impinges upon the screen such that a virtual image is created from light reflected from the screen, the virtual image appearing to be located behind the screen. An image display apparatus, comprising: an image source, a mount, an at least partially transparent screen, and a pigmented reflective member, the mount being arranged to retain the screen under tension, such that the screen is inclined at an angle with respect to a plane of emission of light from the image source; the screen having a front surface arranged such that light emitted from the image source is reflected therefrom; and the image source being arranged to provide an image such that light forming the image impinges upon the screen such that a virtual image is created from light reflected from the screen, the virtual image appearing to be located behind the screen, the apparatus further comprising a stage, and a stage background, the screen being provided in front of the stage, wherein a plurality of light sources are arranged to illuminate at least part of at least one of the stage or stage background, and the pigmented reflective member being provided in an optical pathway between the image source and the screen and being operative to reflect only light from part of the visible spectrum such that the pigmented reflective member reduces a milky hue associated with light where there is no image to be presented surrounding a Pepper's Ghost image to compensate for variations in levels of unwanted light hitting the surface of the screen; wherein the screen is a polymeric transparent foil that is held taught and substantially wrinkle-free by the retention members, the retention members having generally parallel faces which clamp an edge region of the foil between them, and wherein individually variable foil tensioning mechanisms are provided at spaced apart locations around the periphery of the foil to enable the foil to have tensioning force independently varied at the said spaced apart locations around the periphery of the foil, and wherein the retention members are connected to one or more flexible tensioning means, which extend from the mount, the foil, flexible tensioning means and the mount lying in a common inclined plane, with the tension on the foil being applied in the plane of the flexible tensioning means and the foil; first and second of the retention members are provided to grip the screen, the retention members having respective openings therethrough arranged to collocate with openings in respective jaws of clamping members attached to tensioning straps; and the tensioning straps are attached to a truss arrangement are adjustable such that the tension of the screen within the truss arrangement can be varied about the periphery of the screen, and wherein the retention members are substantially parallel to truss members comprising the truss arrangement.

U.S. Published Patent Application Document No. 20110319152 (Ross) describes gaming devices, gaming systems, methods of conducting a wagering game, and computer programs for initiating a wagering game are presented herein. A gaming device is presented that includes a wager input device for receiving wagers from players to play a wagering game, and a display for displaying outcomes of the wagering game. The gaming device also includes a multi-layer composite lighting assembly with a first light-emitting layer, a second light-emitting layer, and a spacer. The first light-emitting layer emits light of a first color in a first direction, whereas the second light-emitting layer emits light of a second color in a second direction. The spacer, which is interposed between the first and second light-emitting layers, diffuses and focuses light emitted by the second light-emitting layer through the light emitted by the first light-emitting layer to thereby create a three-dimensional simulation of a component of the wagering game.

U.S. Published Patent Application Document No. 20110281628 (Sieka) describes an outcome of a dice throw and an orientation of the dice can be randomly determined. Based on knowledge of the outcome of the dice throw and the orientation of the dice, die faces that face the player at a beginning time instant of the animated motion can be back calculated. The dice can then be accordingly constrained to a selected one of a number of predefined animations for the dice to efficiently generate a more realistic and accurate graphical representation of the dice throw on the wagering game machine. Such a technique for generating the graphical representation of the dice throw based on 3D modeling and physics of the dice throw precludes managing and maintaining texture maps. Also, the graphical representation of the dice throw can be presented without texture swapping and with less computation because the pre-modeled dice are constrained to the selected animation of the dice.

U.S. Pat. No. 7,922,589 describes electronic game tables with multifunction legs are described. In one implementation, an electronic multiplayer game table includes a tabletop with player stations for an electronic betting game. Multifunction legs physically support the periphery of the tabletop, while electronic components for playing the betting game are mounted in the multifunction legs. For example, a multifunction leg may contain multiple currency detectors and coinless slot machine-style ticket printers/readers, so that each player at the game table has an exclusive currency detector and an exclusive ticket printer in close proximity. The multifunction legs may also include magnetic or smart card readers for transferring player, banking, and monetary information. In a variation, central control components of the electronic game table are also mounted in the legs. The multifunction legs can eliminate the need for a central support pedestal. This enables efficient under-table cooling schemas and other innovations, such as under-table lighting and a central tabletop holograph space.

Published US patent Application Document No. 20090109175 describes a system for a 3 dimensional (3-D) user interface comprises: one or more 3-D projectors configured to display an image at a first location in a 3-D coordinate system; one or more sensors configured to sense user interaction with the image and to provide user interaction information; and a processor configured (i) to receive the user interaction information from the one or more sensors; (ii) to correlate the user interaction with the image; and (iii) to provide one or more indications responsive to a correlation of the user interaction with the image, wherein the one or more indications comprise displaying the image at a second location in the 3-D coordinate system. A method for providing a 3-D user interface comprises: generating an image at a first location in a 3-D coordinate system; sensing user interaction with the image; correlating the user interaction with the image; and providing one or more indications responsive to a correlation of the user interaction with the image, wherein the one or more indications comprise displaying the image at a second location in the 3-D coordinate system. Computer readable program codes related to the system and the method of the present invention are also described herein.

All references cited herein are incorporated by reference in their entirety to provide enabling disclosure of technical aspects used in the practice of the present technology.

SUMMARY OF THE INVENTION

A gaming system provides a wagering venue for multiple wagering positions. The system may have at least components of:

a) a processor configured to execute code to simulate a physical random gaming event outcome using a random number generator;

b) memory storing three-dimensional video displayable image data of a device useful in providing the physical random gaming event outcome;

c) a three-dimensional video display system having a three-dimensional image display field viewable within an at least 30 degree field of view;

d) at least two player input terminals and seating for the player input terminals within the at least 30 degree field of view.

The processor may be configured i) to identify a wager from a specific player input terminal, ii) to initiate generation of an event outcome in a random event outcome game, iii) to generate an event outcome simulating a physical random event generating outcome; iv) to select image data from the memory of a three-dimensional event outcome in which the generated simulated physical random event outcome is shown; v) displaying the selected image data; and to resolve the wager based upon the generated event outcome.

DETAILED DESCRIPTION OF THE INVENTION

Figure 1:
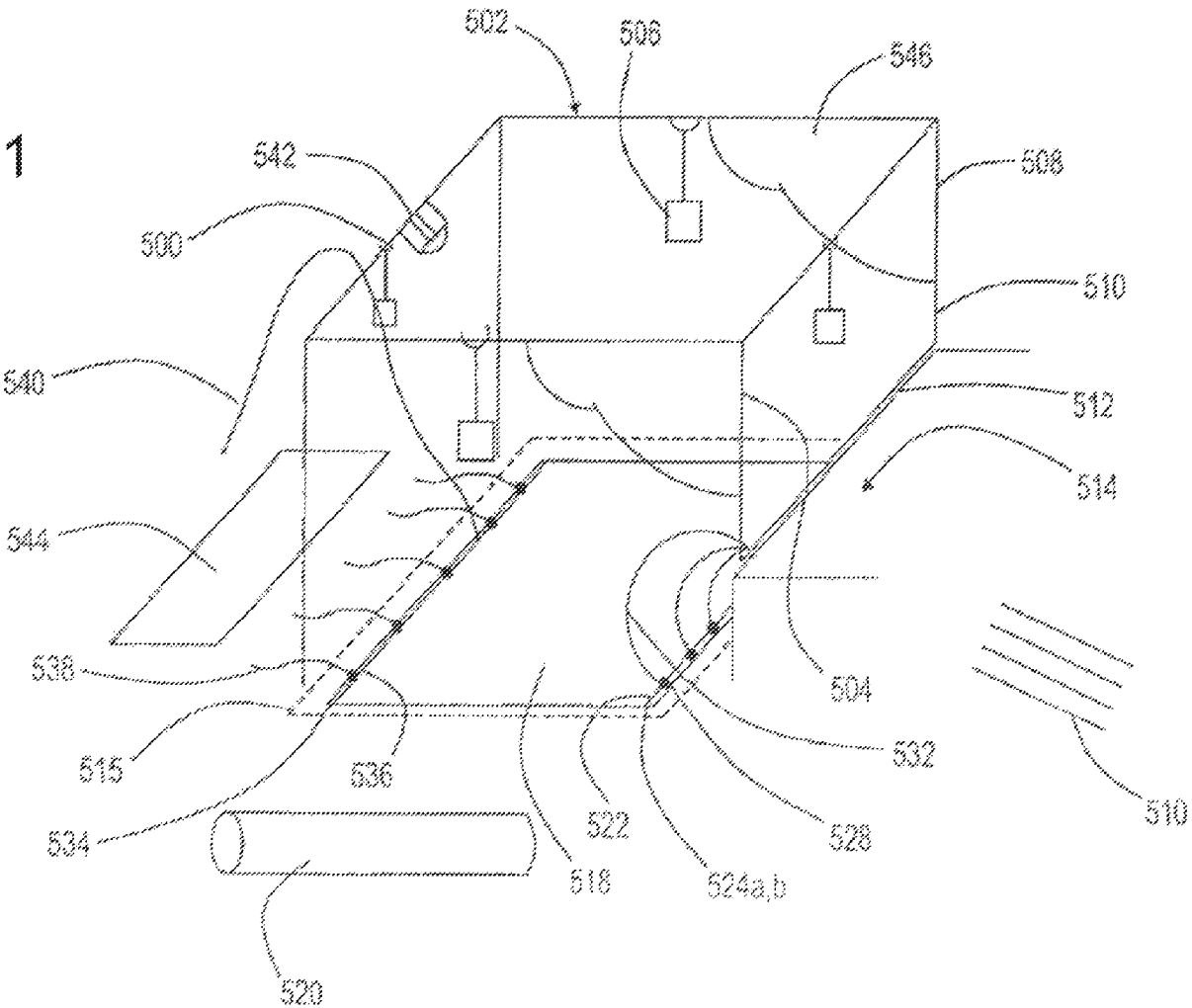
FIG. 1 is a schematic view of a projection apparatus according to the teachings of the Prior Art represented by U.S. Pat. No. 8,177,368.

A gaming system provides a wagering venue for multiple wagering positions and a three-dimensional or holographic display of game events. The basic equipment desirable for performing the process and forming the system may include:

a) a processor configured to execute code to simulate a physical random gaming event outcome using a random number generator. A commercially available gaming processor or central processor may be used. The processor may be provided with memory, flash memory, EPROM, EEPROM, RAM, ROM, input/output ports, hard-wire or wireless communication enabling capability and the like.

b) memory storing three-dimensional video displayable image data of a device useful in providing the physical random gaming event outcome. The displayable image data may be segmented or may be in a continuous format. In segmented format, a first generic image data set would display a generic movement of the virtual random event generations system would be shown. For example, a first generic segment of a spinning roulette wheel with revolving ball around the edge may be shown, bouncing dice, spinning candy wheel, cards being dealt face down, and the like can be show. An individual, specific segment may be transferred from memory to the three-dimensional display system at the end of the generic segment. The individual, specific display data segment would then show the virtual image of the random number generated determined outcome for the game event. This method reduces the total amount of data that must be stored in displaying outcomes. This is particularly important where a single processor stores multiple games thereon.

c) a three-dimensional video display system having a three-dimensional image display field viewable within an at least 30 degree field of view. The field of view may be larger to accommodate more displays. Depending upon the size of the display, the nature of the display system, its inherent or modifiable available angle of vision and the number and position of player input terminals, the field of view may be required to be up to 180 degrees or 360 degrees. It is also possible for multiple display systems to be arranged to expand the functional field of view available from a single component system.

d) at least two player input terminals and seating for the player input terminals within the at least 30 degree field of view;

wherein the processor is configured i) to identify a wager from a specific player input terminal, ii) to initiate generation of an event outcome in a random event outcome game, iii) to generate an event outcome simulating a physical random event generating outcome; iv) to select image data from the memory of a three-dimensional event outcome in which the generated simulated physical random event outcome is shown; v) displaying the selected image data; and resolving the wager based upon the generated event outcome.

The three-dimensional imaging system may include a separate computer/processor or additional capacity in the underlying computer for the system. In computers, 3-D (three dimensions or three-dimensional) describes an image that provides the perception of depth. When 3-D images are made interactive so that users feel involved with the scene, the experience is called virtual reality. In a personal computer system, the user usually needs a special plug-in viewer for the Web browser to view and interact with 3-D images. Virtual reality experiences may also require additional equipment.

3-D image creation can be viewed as a three-phase process of: tessellation, geometry, and rendering. In the first phase, models are created of individual objects using linked points that are made into a number of individual polygons (tiles). In the next stage, the polygons are transformed in various ways and lighting effects are applied. In the third stage, the transformed images are rendered into objects with very fine detail. Popular products for creating 3-D effects include Extreme 3D, LightWave 3D, Ray Dream Studio, 3D Studio MAX, Softimage 3D, and Visual Reality. The Virtual Reality Modeling Language (VRML) allows the creator to specify images and the rules for their display and interaction using textual language statements.

High speed display of three-dimensional images from caches of memory are enabled by techniques such as those of (http://www.cs.princeton.edu/courses/archive/spr01/cs598b/papers/schaufler96.pdf), A Three Dimensional Image Cache for Virtual Reality, Gernot Schaufler and Wolfgang Stürzlinger, GUP, Johannes Kepler Universität Linz, Altenbergerstr. 69, A-4040 Linz, Austria/Europe.

A particular imaging system within the scope of the present technology includes a gaming system for providing a wagering venue for multiple wagering positions. The system may have:

a) a processor configured to execute code to simulate a physical random gaming event outcome using a random number generator;
b) memory storing three-dimensional video displayable image data of a device useful in providing the physical random gaming event outcome;
c) a three-dimensional video display system having a three-dimensional image display field viewable within an at least 30 degree field of view;
d) at least two player input terminals and seating for the player input terminals within the at least 30 degree field of view;

wherein the processor is configured i) to identify a wager from a specific player input terminal, ii) to initiate generation of an event outcome in a random event outcome game, iii) to generate an event outcome simulating a physical random event generating outcome; iv) to select image data from the memory of a three-dimensional event outcome in which the generated simulated physical random event outcome is shown; v) to display the selected image data; and vi) to resolve the wager based upon the generated event outcome; wherein the three-dimensional image display system comprises an image display apparatus, comprising: an image source, a mount, an at least partially transparent screen, and a pigmented reflective member, the mount being arranged to retain the screen under tension, such that the screen is inclined at an angle with respect to a plane of emission of light from the image source; the screen having a front surface arranged such that light emitted from the image source is reflected therefrom; and the image source being arranged to provide an image such that light forming the image impinges upon the screen such that a virtual image is created from light reflected from the screen, the virtual image appearing to be located behind the screen, the apparatus further comprising a stage, and a stage background, the screen being provided in front of the stage, wherein a plurality of light sources are arranged to illuminate at least part of at least one of the stage or stage background, and the pigmented reflective member being provided in an optical pathway between the image source and the screen and being operative to reflect only light from part of the visible spectrum such that the pigmented reflective member reduces a milky hue associated with light where there is no image to be presented surrounding a Pepper's Ghost image to compensate for variations in levels of unwanted light hitting the surface of the screen; wherein an angle of inclination of the pigmented reflective member with respect to the plane of emission of light from the image source is variable.

The gaming system may have at least two of the player input terminals comprise free-standing individual gaming terminals with player input controls or at least two banked gaming terminals and at least one of the player input terminals may comprise a portable handheld device in wireless communication with the processor. There may be multiple rows of multiple player input controls within the 30 degree field of view, creating an arena or amphitheater setting.

The processor may be configured with software in memory to execute game rules of at least two different games selected from the group consisting of roulette, bingo, dice games, playing card games and spinning wheel games. The processor may be configured with software in memory to execute game rules of at least two different games selected from the group consisting of roulette, bingo, dice games, playing card games and spinning wheel games. The processor may be configured with software in memory to execute game rules of at least two different games selected from the group consisting of roulette, bingo, dice games, playing card games and spinning wheel games. The processor may be configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

Each wagering environment, which may be a casino or an amphitheater within a casino may include a local area network, which may include an access point from a central server/processor (which may service the single wagering environment or multiple wagering environments), a wagering game server, and the individual player input wagering game systems or terminals. The access point (the I/O connection at the individual wagering environment to the main server/processor) preferably provides wireless communication links, although wired communication links may also be used. The wired and wireless communication links can employ any suitable connection technology, such as Bluetooth, 802.11, Ethernet, public switched telephone networks, SONET, etc. In some embodiments, the wagering game server can serve wagering games and distribute content to devices located in other casinos or at other locations on the communications network.

There may be a content server, game server or central gaming processor that comprises a wagering game three-dimensional animations/image database, an object movement result generator, and a compositing unit. The compositing unit would be coupled with the object movement result generator and with the wagering game animations database.

The compositing unit selects one of multiple pre-generated and stored wagering game animations (e.g., dice throw animations, roulette spins, wheel spins, cards dealt, etc.) from the wagering game animations database responsive to initiation of play after wagers have been accepted, so as to present a wagering game animation. The object movement result generator determines an outcome of a wagering game that involves object movement (e.g., a dice throw) and an orientation of the object(s) to be presented by the display stage central to the gaming system. The outcome is randomly determined (e.g., by a random number generator), the final orientation of the object(s) in displaying the event outcome must represent the specifically determined random event outcome. For example, a pre-determined three-dimensional image indicating the dice being randomized (e.g., shaken in a virtual container or in a virtual hand) is provided (e.g., as the generic segment of the display) and then the final orientation of dice for a given outcome of a dice throw is displayed as the final segment. The compositing unit determines, based on the random number generated outcome of the dice throw and the orientation of the dice, a final image display position of the virtual three-dimensional display of the dice. The compositing unit also may constrain the virtual image of the dice in throw animation based on knowledge of the initial state of the virtual dice (which the system may allow an individual player among the multiple players to set the virtual dice as the shooter) to assist in generating the virtual dice throw graphics. The three-dimensional segment or continuous image content server then provides the virtual dice throw graphics to the wagering game machine. It is noted that in some implementations, the content server may comprise a simulation unit that simulates object movement for wagering games subject to parameters that correspond to the object (e.g., a dice throw subject to dice throw parameters and laws of physics to generate the dice throw animation). In other implementations, the wagering game animations may be generated on another server and may be uploaded to the content server.

Embodiments are not limited to implementing functionality of the compositing unit within the content. The content server can select the dice throw animation and can determine the outcome of the dice throw and the orientation of the dice, while the wagering game machine can determine the initial state of the dice and can appropriately constrain the dice to the dice throw animation to generate the dice throw graphics. The wagering game machines described herein can take any suitable form, such as floor standing models, handheld mobile units, table top models, workstation-type console models, etc. Further, the wagering game machines can be primarily dedicated for use in conducting wagering games, or can include non-dedicated devices, such as mobile phones, personal digital assistants, personal computers, etc. In one embodiment, the wagering game network can include other network devices, such as accounting servers, wide area progressive servers, player tracking servers, and/or other devices suitable for use in connection with embodiments of the invention.

In some embodiments, wagering game machines and wagering game servers work together such that a wagering game machine can be operated as a thin, thick, or intermediate client. For example, one or more elements of game play may be controlled by the wagering game machine (client) or the wagering game server (server). Game play elements can include executable game code, lookup tables, configuration files, game outcome, audio or visual representations of the game, game assets, or the like. In a thin-client example, the wagering game server 506 can perform functions such as determining game outcome or managing assets, while the wagering game machine can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server can provide functionality that is not directly related to game play. For example, account transactions and amount rules may be managed centrally (e.g., by the wagering game server) or locally (e.g., by the wagering game machine 502). Other functionality not directly related to game play may include power management, presentation of advertising, software or firmware updates, system quality or security checks, etc.

Any of the wagering game network components (e.g., the wagering game machines) can include hardware and machine-readable media including instructions for performing the operations described herein.

Amphitheater Design

Referring now to FIG. 1, which displays a 3D Holographic amphitheater according to U.S. Pat. No. 8,177,368 a box truss framework 500 comprises a square upper truss work 502 and leg trusses 504. In constructing the framework 500 the upper truss work 502 rests upon a number of jacks 506. First sections 508 of the leg trusses 504 that extend at right angles to the upper truss work 502 are added at the corners of the upper truss work 502. The height of the jacks 506 is increased to allow additional sections 510 of the leg trusses 504 to be added until the desired height of the box truss framework 500 is achieved.

A cross-piece truss 512 is fixed to two of the leg trusses 504 such that it horizontally spans the gap therebetween at a height close to, and typically slightly below, the level of a stage floor 514. The leg trusses 504 spanned by the cross-piece truss 512 constitute the rear legs of the framework 500 and are located adjacent the front of the stage floor 514.

A dust-free protective plastic sheet 515 is laid across the width of the stage floor 514 in front of the rear legs of the framework 500. A roll of screen film 518 is removed from a protective cylindrical casing 520 and is unwound across the width of the stage floor 514. The film 518 is placed upon the sheet 515 in order to prevent damage to the surface from dust particles or other sharp protrusions.

A lower edge 522 of the film 518 is placed between jaws 524*a,b* of a retention member 526, each jaw 524*a,b* having opposed openings therethrough spaced at approximately 0.5 m intervals. Bolts 528 are placed through the openings, and through the film 518, and secured in position using respective nuts. Ratchet straps 532 are attached to the retention member 526 adjacent alternate bolts 528, having a spacing of approximately Im, and are then attached to the cross-piece truss 512.

A second retention member 534 is attached to an upper edge 536 of the film 518 in a similar manner to how the retention member 526 is attached to the lower edge 522. Ratchet straps 538 are attached to the second retention member 534.

A rope 540 is tied to the second retention member 534 and is passed over the upper truss work 502 opposite the cross-piece truss 512. The film is raised into position using the rope 540 and the ratchet straps 538 are attached to the upper truss work 502. Both sets of ratchet straps 532, 538 are tightened individually until the screen film is tensioned such that the film 518 is flat and, ideally, free from wrinkles.

A projector 542 is depended from the upper truss work 502 and a pigmented reflective board 544 is placed between the screen 518 and the front edge of the box truss framework 500 such that light emitted by the projector 542 is reflected from the board 544 onto the screen 518. The screen 518 reflects at least part of the light from a front surface thereof away from the stage and into an auditorium to be viewed by an audience.

In order to prevent the audience observing the projection apparatus both side and front drapes 546 are used to screen the apparatus from the audience.

Wagering Game Machine Architectures

Figure 2:
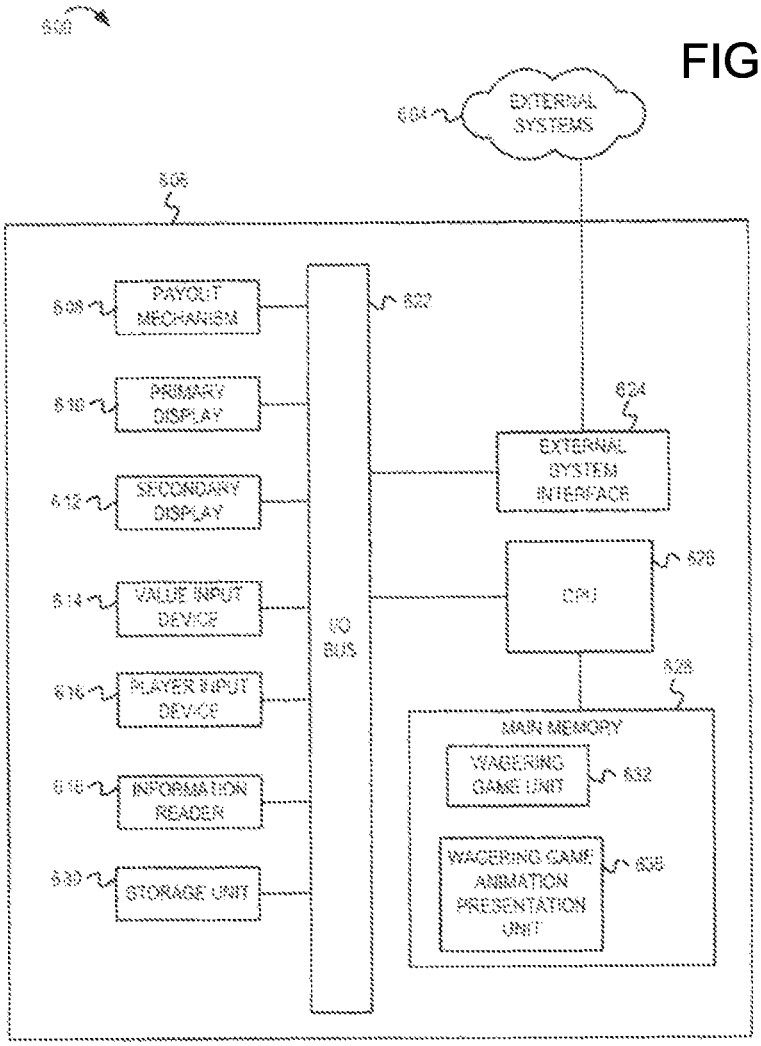
FIG. 2 is a block diagram illustrating wagering game machine architecture 600, according to example embodiments of the invention.

FIG. 2 is a block diagram illustrating Prior Art wagering game machine architecture 600, according to example embodiments of the invention. As shown in FIG. 6, the wagering game machine architecture 600 includes a wagering game machine 606, which includes a central processing unit (CPU) 626 connected to main memory 628. The CPU 626 can include any suitable processor, such as an Intel™ Pentium processor, Intel® Core 2 Duo processor, AMD Opteron® processor, or Ultra SPARC processor. The main memory 628 includes a wagering game unit 632 and a wagering game animation presentation unit 638. In one embodiment, the wagering game unit 632 can present the wagering games described herein, in whole or part.

The wagering game animation presentation unit 638 receives wagering game animations generated by a content server (e.g., the content server described above) and presents the wagering game animations on a primary display 610 and/or a secondary display 612 of the wagering game machine 600 in accordance with instructions from a content server. In some implementations, the main memory 628 may also comprise a compositing unit. The compositing unit can receive, from the content server, a template animation, a randomly generated wagering game outcome, and an orientation of an object(s) of the wagering game. The compositing unit can generate the wagering game animation and present the wagering game animation on the primary display 610 and/or the secondary display 612 of the wagering game machine 600 based on the template animation, the outcome, and the orientation of the object(s).

The CPU 626 is also connected to an input/output (I/O) bus 622, which can include any suitable bus technologies, such as an AGTL+ frontside bus and a PCI backside bus. The I/O bus 622 is connected to a payout mechanism 608, the primary display 610, the secondary display 612, value input device 614, player input device 616, information reader 618, and storage unit 630. The player input device 616 can include the value input device 614 to the extent the player input device 616 is used to place wagers. The I/O bus 622 is also connected to an external system interface 624, which is connected to external systems 604 (e.g., wagering game networks).

In one embodiment, the wagering game machine 606 can include additional peripheral devices and/or more than one of each component shown in FIG. 6. For example, in one embodiment, the wagering game machine 606 can include multiple external system interfaces 624 and/or multiple CPUs 626. In one embodiment, any of the components can be integrated or subdivided.

Any component of the architecture 600 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). Machine-readable media can be machine-readable storage media or machine-readable signal media. Examples of machine-readable storage media include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. Examples of machine-readable signal media can be in the form of an electro-magnetic signal, an optical signal, or any suitable combination thereof.

A graphical user interface (GUI) is a type of computer application user interface that allows people to interact with a computer and computer-controlled devices. A GUI typically employs graphical icons, visual indicators or special graphical elements, along with text, labels or text navigation to represent the information and actions available to a user. The actions are usually performed through direct manipulation of the graphical elements.

Holographic images can be created as single or consecutive images using available holographic technology. These technologies include mirrors, lasers, light and images strategically positioned to cause the proper reflection to yield a holographic image broadcast through an entry point in the laser and mirror positioning system. Black background and rooms with low or no light may enhance the appearance of the holographic image or images, which may also use a holographic plate as a display medium. Holographic systems may be large in size and spread out over a large broadcasting area or may be compact enough to fit in spaces smaller than a desk top. Holographic technology is only limited in size by the size of the component parts. By using holographic technology, images may be displayed multi-dimensionally, rather simply on a planar projection.

Currently progress has been made in technologies that can enhance the capability and range of holographic media in projects that employ multi-million minor systems and via companies that have designed specialized high speed and high capacity micro processors for specialized jobs, other than holographic systems, where the technology could be applied to holographic technologies to make possible the proper positioning of millions of mirrors at a rate of between 24 to 60 or more frames of video per second, with corresponding synched audio.

Holographic displays generated over the last 20-year period utilize various configurations including lasers with images on glass plates such as an AGFA 8E75HD glass plate or other glass plates as well a laser such as a Spectra Physics 124B HeNe laser, a 35 mW laser diode system utilizing different processing methods such as pyrochrome processing. Split beam techniques can also be used Multi H1 to Multi H2. Such configurations as 8.times.10, triethanolomine, from Linotronic 300 image setter film are also commonly utilized or a configuration with rear-illuminated for 30.times.40 cm reflection hologram, where a logo floats 18-inches in front of the plate.

Figure 3:
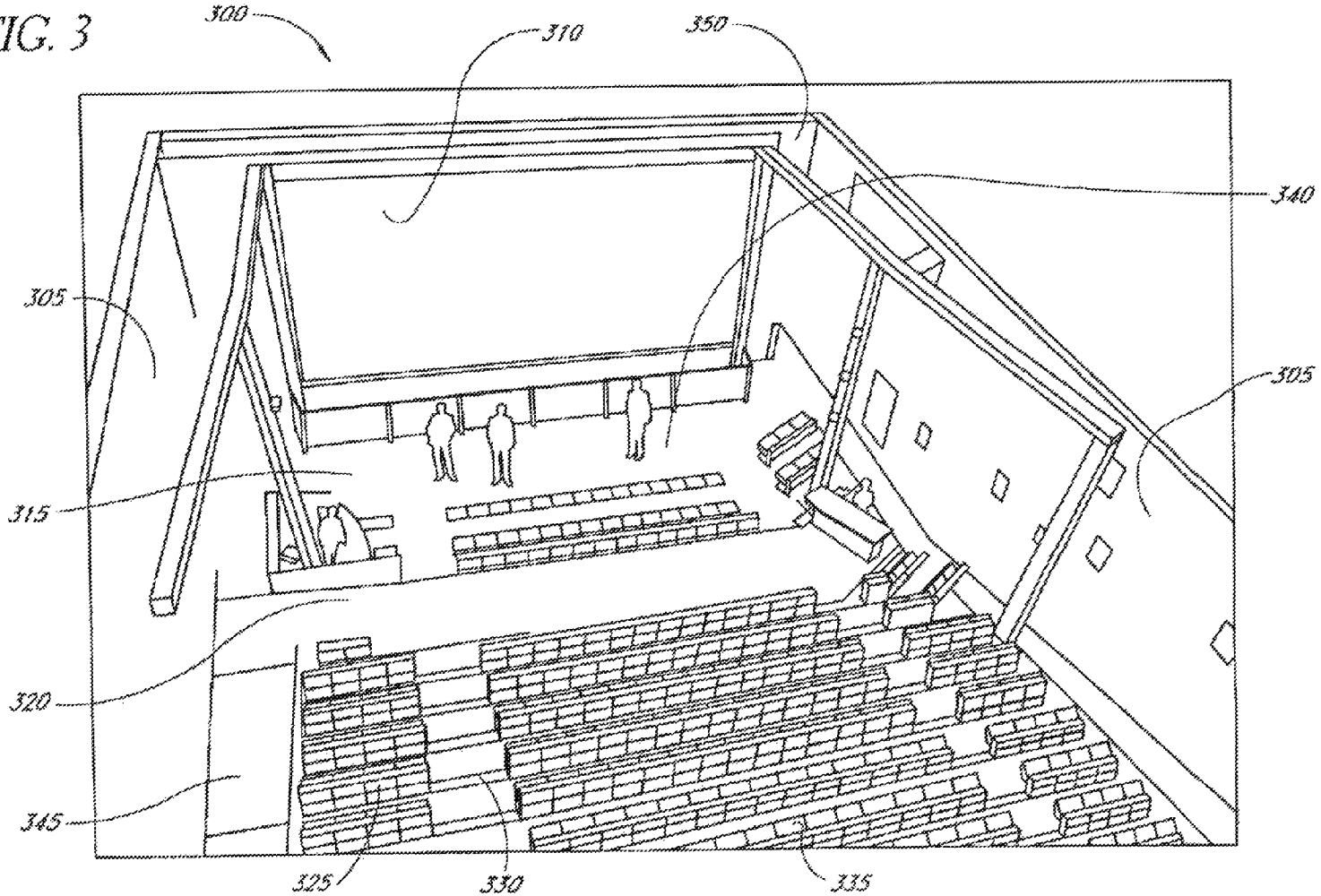
FIG. 3 is a perspective overview of an example of an enclosed theater system with seating for engaging in three-dimensional systems according to the present technology.

FIG. 3 is a perspective overview of an example of an enclosed theater system 300 with seating 325, 335 for engaging in three-dimensional systems according to the present technology. The screen 310 is positioned with walk spaces 315, 340, 320, 345 and 330 distributed about the seating 325 and 335. Walls 305 enclose the theater system 300. Space between the screen 310 and a back frame/wall system 350 can be used to store apparatus (not shown) used in creating the three-dimensional gaming images used within the scope of the present technology.

Published US Patent Application Document No. 20090109175 describes a system for a 3 dimensional (3-D) user interface comprises: one or more 3-D projectors configured to display an image at a first location in a 3-D coordinate system; one or more sensors configured to sense user interaction with the image and to provide user interaction information; and a processor configured (i) to receive the user interaction information from the one or more sensors; (ii) to correlate the user interaction with the image; and (iii) to provide one or more indications responsive to a correlation of the user interaction with the image, wherein the one or more indications comprise displaying the image at a second location in the 3-D coordinate system. A method for providing a 3-D user interface comprises: generating an image at a first location in a 3-D coordinate system; sensing user interaction with the image; correlating the user interaction with the image; and providing one or more indications responsive to a correlation of the user interaction with the image, wherein the one or more indications comprise displaying the image at a second location in the 3-D coordinate system. Computer readable program codes related to the system and the method of the present invention are also described herein. This progressive display of pre-enabled holographic displays is less preferred in the practice of the present technology, but must be considered as an optional embodiment herein. In this technology, some user interfaces have adopted a multi-dimensional interface approach. For example, the "heliodisplay" of 102 Technology, LLC of San Francisco, Calif. projects images into a volume of free space, i.e. into an aerosol mixture such as fog or a gas, and may operate as floating touchscreen when connected to a PC by a USB cable. However, with the heliodisplay, the image is displayed into two-dimensional space (i.e. planar). While the Heliodisplay images appear 3 dimensional ("3-D"), the images are planar and have no physical depth reference. Unfortunately, these existing uses have certain limitations in distribution and deployment. For example, functionally, the heliodisplay is a two dimensional display that projects against a curtain of air, or even glass. While, the heliodisplay may give the appearance of 3-D, the images displayed and the interface are 2-D. As such, the heliodisplay is not a true 3-D holographic display, and thus the interface operates on a two-dimensional plane, not taking advantage of a full three dimensional coordinate system.

Accordingly, one would likely use an integrated user interface that utilizes true 3-D technology to create a computing and multimedia environment where a user can easily navigate by touch, mouse or pointer system to effectively navigate the interface to raise the level of the user experience to a true 3-D environment, with the goal of attaining elements of the attenuated clarity, realism and benefits of that environment that match our day to day conventional interactions with the 3-D world. The present invention relates to the creation of a holographic user interface display system that combines physical media or digitally stored files with a digital holographic player hardware system. The result is the creation of a multimedia holographic user interface and viewing experience, where a variety of graphical schematics enabling cohesive access to information utilizing pyramids, blocks, spheres, cylinders, other graphical representations, existing templates, specific object rendering, free form association, user delegated images and quantum representations of information to form a user interface where the available tools combine over time to match a users evolving data and requests.

What is claimed is:

1. A gaming system for providing a wagering venue for multiple wagering positions comprising:

a) a processor configured to execute code to simulate a physical random gaming event outcome using a random number generator;

b) memory storing three-dimensional video displayable image data of a device useful in providing the physical random gaming event outcome;

c) a three-dimensional video display system having a three-dimensional image display field viewable within an at least 30 degree field of view;

d) at least two player input terminals and seating for the player input terminals within the at least 30 degree field of view;

wherein the processor is configured i) to identify a wager from a specific player input terminal, ii) to initiate generation of an event outcome in a random event outcome game, iii) to generate an event outcome simulating a physical random event generating outcome; iv) to select image data from the memory of a three-dimensional event outcome in which the generated simulated physical random event outcome is shown; v) to display the selected image data; and vi) to resolve the wager based upon the generated event outcome.

2. The gaming system of claim 1 wherein at least two of the player input terminals comprise free-standing individual gaming terminals with player input controls or at least two banked gaming terminals.

3. The gaming system of claim 1 wherein at least one of the player input terminals comprises a portable handheld device in wireless communication with the processor.

4. The gaming system of claim 2 wherein there are multiple rows of multiple player input controls within the 30 degree field of view.

5. The gaming system of claim 1 wherein the processor is configured with software in memory to execute game rules of at least two different games selected from the group consisting of roulette, bingo, dice games, playing card games and spinning wheel games.

6. The gaming system of claim 2 wherein the processor is configured with software in memory to execute game rules of at least two different games selected from the group consisting of roulette, bingo, dice games, playing card games and spinning wheel games.

7. The gaming system of claim 3 wherein the processor is configured with software in memory to execute game rules of at least two different games selected from the group consisting of roulette, bingo, dice games, playing card games and spinning wheel games.

8. The gaming system of claim 4 wherein the processor is configured with software in memory to execute game rules of at least two different games selected from the group consisting of roulette, bingo, dice games, playing card games and spinning wheel games.

9. The gaming system of claim 1 wherein the processor is configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

10. The gaming system of claim 2 wherein the processor is configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

11. The gaming system of claim 3 wherein the processor is configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

12. The gaming system of claim 8 wherein the processor is configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

13. A gaming system for providing a wagering venue for multiple wagering positions comprising:

a) a processor configured to execute code to simulate a physical random gaming event outcome using a random number generator;

b) memory storing three-dimensional video displayable image data of a device useful in providing the physical random gaming event outcome;

c) a three-dimensional video display system having a three-dimensional image display field viewable within an at least 30 degree field of view;

d) at least two player input terminals and seating for the player input terminals within the at least 30 degree field of view;

wherein the processor is configured i) to identify a wager from a specific player input terminal, ii) to initiate generation of an event outcome in a random event outcome game, iii) to generate an event outcome simulating a physical random event generating outcome; iv) to select image data from the memory of a three-dimensional event outcome in which the generated simulated physical random event outcome is shown; v) to display the selected image data; and vi) to resolve the wager based upon the generated event outcome; wherein the three-dimensional image display system comprises an image display apparatus, comprising: an image source, a mount, an at least partially transparent screen, and a pigmented reflective member, the mount being arranged to retain the screen under tension, such that the screen is inclined at an angle with respect to a plane of emission of light from the image source; the screen having a front surface arranged such that light emitted from the image source is reflected therefrom; and the image source being arranged to provide an image such that light forming the image impinges upon the screen such that a virtual image is created from light reflected from the screen, the virtual image appearing to be located behind the screen, the apparatus further comprising a stage, and a stage background, the screen being provided in front of the stage, wherein a plurality of light sources are arranged to illuminate at least part of at least one of the stage or stage background, and the pigmented reflective member being provided in an optical pathway between the image source and the screen and being operative to reflect only light from part of the visible spectrum such that the pigmented reflective member reduces a milky hue associated with light where there is no image to be presented surrounding a Pepper's Ghost image to compensate for variations in levels of unwanted light hitting the surface of the screen; wherein an angle of inclination of the pigmented reflective member with respect to the plane of emission of light from the image source is variable.

14. The gaming system of claim 13 wherein at least two of the player input terminals comprise free-standing individual gaming terminals with player input controls or at least two banked gaming terminals.

15. The gaming system of claim 13 wherein at least one of the player input terminals comprises a portable handheld device in wireless communication with the processor.

16. The gaming system of claim 14 wherein there are multiple rows of multiple player input controls within the 30 degree field of view.

17. The gaming system of claim 14 wherein the processor is configured with software in memory to execute game rules of at least two different games selected from the group consisting of roulette, bingo, dice games, playing card games and spinning wheel games.

18. The gaming system of claim 16 wherein the processor is configured with software in memory to execute game rules of at least two different games selected from the group consisting of roulette, bingo, dice games, playing card games and spinning wheel games.

19. The gaming system of claim 13 wherein the processor is configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

20. The gaming system of claim 16 wherein the processor is configured with software in memory to execute game rules of at least roulette and to display on the three-dimensional display system three-dimensional images of a) a virtual spinning roulette wheel with spinning virtual roulette ball or b) a virtual roulette ball moving about the rim of a stationary roulette wheel.

* * * * *